US005280778A

United States Patent [19]

Kotsiopoulos

[11] Patent Number: 5,280,778

[45] Date of Patent: Jan. 25, 1994

[54] SEMI-AUTOMATIC FIRING COMPRESSED GAS GUN

[76] Inventor: Thomas G. Kotsiopoulos, 449 Sunset Ridge Rd., Northfield, Ill. 60093

[21] Appl. No.: 847,831

[22] Filed: Mar. 9, 1992

Related U.S. Application Data

[63] Continuation of Ser. No. 541,707, Jun. 21, 1990, abandoned.

[51] Int. Cl.[5] ..... F41B 11/00

[52] U.S. Cl. ..... 124/73; 124/71; 124/31

[58] Field of Search ..... 124/73-76, 124/71, 70, 37, 31

[56] References Cited

U.S. PATENT DOCUMENTS

| | | | |
|---|---|---|---|
| 2,699,767 | 1/1955 | Mangolini . | |
| 2,817,328 | 12/1957 | Gale . | |
| 3,527,194 | 9/1970 | Vadas | 124/37 X |
| 3,542,008 | 11/1970 | Vadas | 124/76 |
| 3,717,947 | 2/1973 | Nomura . | |
| 3,765,396 | 10/1973 | Kienholz et al. . | |
| 3,788,298 | 1/1974 | Hale | 124/76 |
| 3,802,408 | 4/1974 | Joyce . | |
| 3,921,614 | 11/1975 | Fogelgren . | |
| 4,116,193 | 9/1978 | Chiba . | |
| 4,531,503 | 7/1985 | Shepherd . | |
| 4,616,622 | 10/1986 | Milliman . | |
| 4,774,929 | 10/1988 | Milliman | 124/76 |
| 4,819,609 | 4/1989 | Tippmann . | |
| 4,936,282 | 6/1990 | Dobbins et al. . | |

*Primary Examiner*—Eric K. Nicholson
*Assistant Examiner*—Anthony Knight
*Attorney, Agent, or Firm*—Leydig, Voit & Mayer, Ltd.

[57] ABSTRACT

A compressed gas powered gun is disclosed having a semi-automatic firing mechanism for enabling successive firing sequences. The firing mechanism includes a sear having a latch arm, with a cam at one end and an interlocking element at the other end. The cam is positioned to close a firing chamber as the latch arm is rotated. The interlocking element is positioned to concomitantly release an actuating bolt as the latch arm is rotated. A recoil spring repositions the actuating bolt for engagement with the interlocking element upon discharge of the firing chamber.

13 Claims, 5 Drawing Sheets

SEMI-AUTOMATIC FIRING COMPRESSED GAS GUN

This is a continuation of copending applications Ser. No. 07/541,707 filed on Jun. 21, 1990 now abandoned.

FIELD OF THE INVENTION

The invention relates to structures, devices and methods for use in compressed gas powered guns. In particular, the invention relates to a compressed gas powered gun providing a semi-automatic firing arrangement for discharging relatively fragile projectiles such as marking pellets. The firing mechanism of the invention is relatively simple in design and construction and provides an efficient manner for discharging one projectile and then reloading in a ready-to-fire position for discharging a next succeeding projectile.

BACKGROUND OF THE INVENTION

Generally, semi-automatic weaponry enables firing of a cartridge each time the trigger is depressed Such weapons are sometimes referred to as "self-firing". A manual loading weapon, on the other hand, requires appropriate manipulation of the weapon before successive cartridges may be discharged.

A variety of guns using discharged compressed gas for firing relatively fragile projectiles are known employing manual, semiautomatic, and fully automatic arrangements. Compressed gas powered guns are typically useful as tranquilizer guns and pellet marking guns, commonly called paint ball guns. Paint ball marking guns have attained widespread use in a recreational sport known as paint ball warfare, an activity which has captured the imagination of many adults. Typically located in open spaces with varying types of terrain, opposing sides employ guerilla-type strategy to seek out and "kill" one another by marking the opposition with a paint ball. Marking guns are also used to segregate cattle within a herd and for a variety of other purposes.

Marking guns use compressed gas to fire a gelatinous capsule containing a marking material. The marking capsules typically enclose a mixture of water and vegetable coloring so they are not toxic and can be removed from clothing and other surfaces with simple water washing. The capsule breaks on impact with the target dispersing the material to mark the target, for example an opposing player, where hit by the capsule. However, the marking capsule must have sufficient rigidity to avoid breakage during loading and firing operations of the gun.

While various types of manual loading paint ball guns, as well as automatic weapons which fire multiple paint balls upon depression of a trigger are known, the semi-automatic weaponry presently available to paint ball sportsmen and other marking gun enthusiasts, while it may perform satisfactorily under certain circumstances, is overly complex and inefficient. Known semi-automatic firing arrangements typically operate using a "blow-back" method wherein a first source of compressed gas discharges the projectile and a second source of compressed gas operates to return the firing mechanism of the gun to a ready-to-fire position. These devices and methods, however, require considerable compressed gas both to fire and to recoil the firing mechanism of the gun. In addition, such complex firing arrangements are often difficult to operate and maintain and suffer frequent breakdowns after extended periods of use.

SUMMARY OF THE INVENTION

The present invention overcomes the problems of prior compressed air guns by providing a simplified latching and recoil mechanism for enabling successive firing sequences. Generally, a compressed gas powered gun comprises a firing mechanism for discharging projectiles and, upon the discharge of one projectile, recoils and positions a successive projectile in a ready-to-fire position to be subsequently ejected therefrom when a trigger is depressed. In accordance with one embodiment, the compressed gas gun includes a compressed gas source, a firing chamber with pressure regulating means and an on-off flow valve in communication with the compressed gas source and disposed between the firing chamber and the source, and a firing mechanism for sequentially discharging projectiles in a barrel.

The main structural features of the firing mechanism include a pivoting sear member and an actuating bolt assembly with a dog portion and a power piston in communication with the firing chamber. The sear member comprises a latch arm, an interlocking member, a cam section, and an actuating lever element. The interlocking member is attached to the latch arm on one side of the pivot and is adapted to engage the actuating bolt dog portion to restrain the actuating bolt in a ready-to-fire or cocked position. The cam section is located on the other side of the pivot and is operable to actuate the on-off flow valve. The actuating lever element protrudes opposite both the interlocking member and the cam section and is interconnected with the trigger.

Depression of the trigger effects rotation of the latch arm to rotate the interlocking member and to rotate the cam section. This action disengages the interlocking member from the dog portion and drives the cam section toward the flow valve to release the actuating bolt assembly and concomitantly force the on-off flow valve to the closed position. In this way, compressed gas collected in the firing chamber drives the actuating bolt assembly to a fired position. The compressed gas is discharged and released within the actuation bolt and through the barrel of the gun for imparting a force on the projectile.

When the compressed gas exits the barrel of the gun, a recoil spring returns the actuating bolt assembly to the ready-to-fire position. When the trigger is released, fluid pressure moves the flow valve to the open position. The latch arm rotates in a counterclockwise direction in reaction to force applied by the flow valve to the cam to engage the interlocking tab with the dog portion of the actuating bolt. Upon completion of the firing sequence, the actuating bolt assembly is returned to the cocked position and the firing chamber is recharged.

The pressure regulating assembly according to the invention insures that a predetermined level of compressed gas is supplied to the firing chamber. The pressure regulating assembly comprises a valve coupled with a regulating piston. The regulating piston is slidably movable within a longitudinal bore between first and second positions. The longitudinal bore communicates with the source of compressed gas which urges the regulating piston toward the rearward position. A biasing spring having its tension manually controlled by a threaded adjustment cap counteracts the force applied by compressed gas in the firing chamber to urge the regulating piston toward the forward position. When the predetermined pressure level of compressed gas is supplied to the firing chamber, the regulating piston permits the valve to close to maintain an appropriate level of pressure in the firing chamber. On the other hand, when the pressure in the firing chamber falls below the predetermined level, the biasing spring moves the regulating piston to urge the valve open for recharging the firing chamber.

Despite the simple design of the firing mechanism and of the pressure regulating assembly, it is entirely self actuating from the fire position to the ready-to-fire position. The recoil spring urges the actuating bolt and power piston assembly into the ready-to-fire position. Also, it is easy to effect intentional release for beginning the firing sequence of the gun. In addition, the compressed gas pressure received by the gun may be easily controlled.

BRIEF DESCRIPTION OF THE DRAWINGS

For a complete understanding of the invention, reference should now be made to the embodiments illustrated in greater detail in the accompanying drawings and described below by way of example.

In the drawings.

It should be understood that the drawings are not necessarily to scale. In certain instances, details of the actual structure which are not necessary for the understanding of the present invention may have been omitted. It should also be understood, of course, that the invention is not necessarily limited to the particular embodiments illustrated herein.

DETAILED DESCRIPTION OF THE PREFERRED EMBODIMENT

Generally, the present invention relates to a compressed gas powered gun that employs a simplified latching arrangement and firing mechanism for propelling fragile projectiles in a semi-automatic fashion. By way of example, the compressed gas powered gun of the present invention may be used as a marking or paint ball for propelling gelatinous capsules the kind used for medicinal purposes to "mark" a target.

Figure 1:
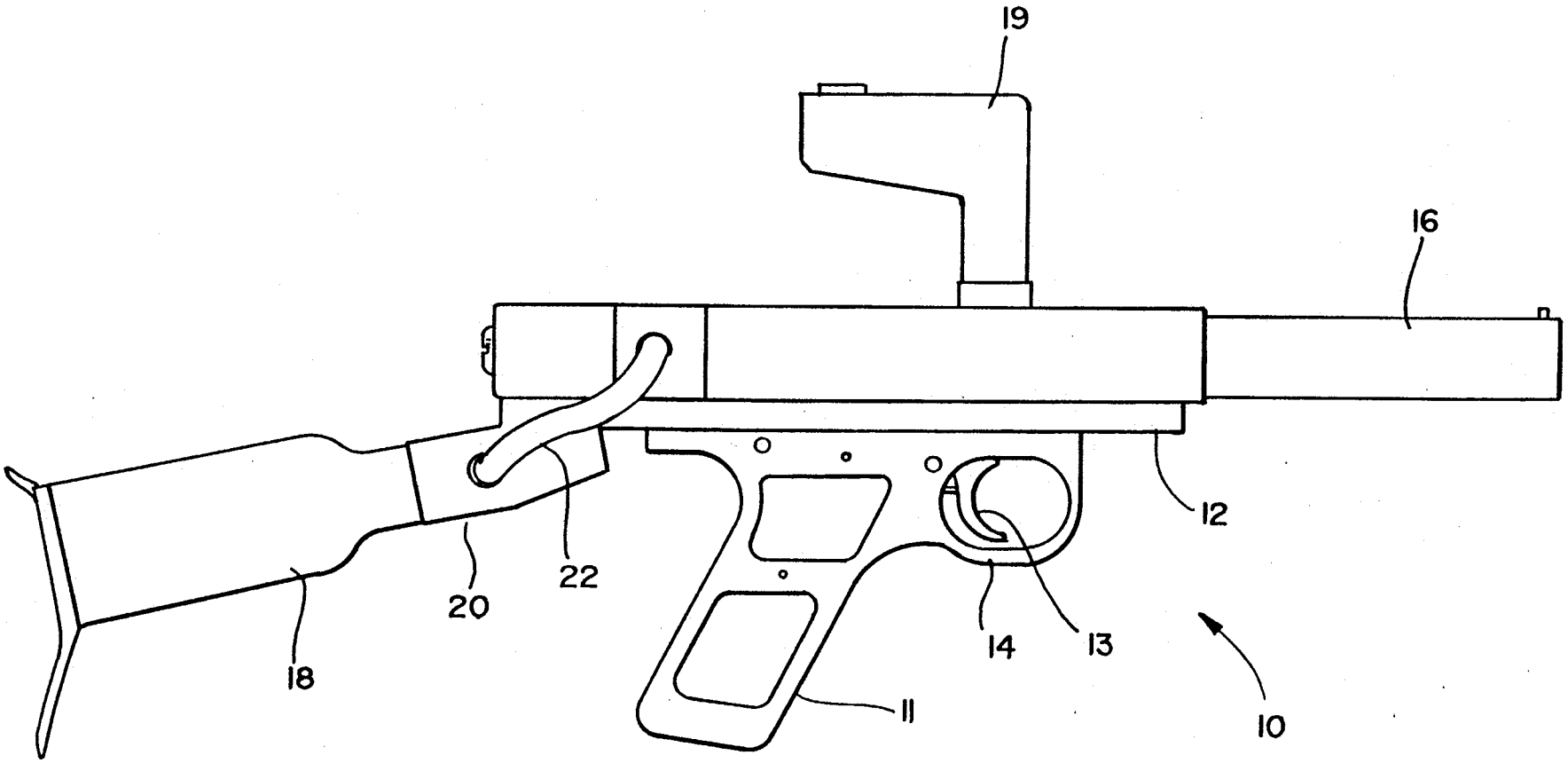
FIG. 1 is a side view of a compressed gas powered gun employing teachings of this invention.
Figure 2:
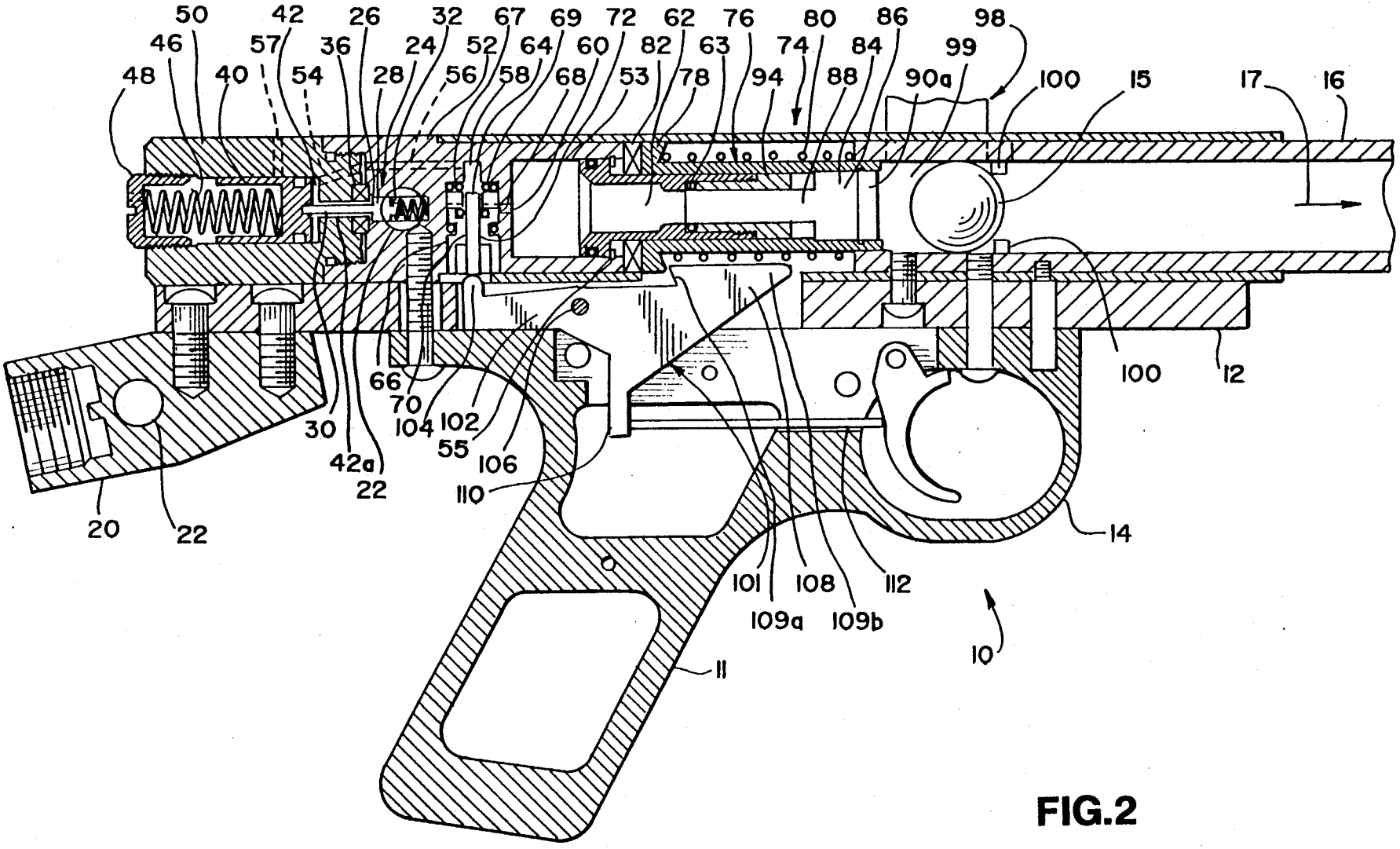
FIG. 2 is a cross-sectional view of the compressed gas gun of FIG. 1 in a ready-to-fire position.

The present invention can be incorporated into a compressed gas gun 10 such as shown in FIGS. 1 and 2. As is common with conventional weaponry, the gun 10 includes a frame support member 12 which supports a handle 11 and a trigger guard 14. A pivotally mounted trigger 13 is disposed within the trigger guard 14. As hereinafter more fully appears, a projectile 15 such as a marking pellet exits an elongated barrel 16 in the direction of the arrow 17 (FIG. 2) during a firing operation. An ammunition receptacle 19 houses a plurality of projectiles to supply the gun 10 as will be understood to those skilled in the art.

In the illustrated embodiment, a cartridge or cannister 18 of the type well known to those skilled in the art contains liquid carbon dioxide ($CO_2$) to supply compressed gas for discharging the projectile 15 from the gun 10. The $CO_2$ cartridge 18 typically contains twelve grams of compressed gas and provides sufficient power for approximately 30 single-shot rounds of the gun 10. The $CO_2$ cartridge 18 generates approximately 850 pounds per square inch (psi) at room temperature and about 450 psi at below 0 degrees Fahrenheit. Accordingly, a varying range of pressure is supplied the gun 10 which adversely impacts the consistency and accuracy of rounds fired in arrangements where no provision is made for changing temperature or weather conditions.

The $CO_2$ cartridge 18 screws into a known type of air tank adapter 20 threadably mounted to the frame support 12. The compressed gas contained in the cartridge 18 passes from the air cartridge adapter 20 via an enclosed inlet passageway 22 (FIG. 1) and is thereafter supplied to a compressed gas delivery system which includes a pressure regulating assembly 24 via the enclosed air passageway 22.

The pressure regulating assembly 24 is disposed in a generally cylindrical terminal housing portion 50 and a generally cylindrical body portion 52 of the gun 10. The terminal housing portion 50 is threadably mounted to the body portion 52, which in turn, is mounted to the frame support member 12. A longitudinal valve chamber 32 is formed in the body portion 52 and communicates with the inlet passageway 22. In addition, the terminal housing portion 50 includes a longitudinal bore 42 extending lengthwise of housing portion 50. Preferably, an end section of the bore 42*a* is formed of a smaller radial dimension than the remaining section of the bore 42.

The terminal section 50 provides a fluid passageway 54 which communicates with a fluid passageway 56 formed in the body portion 52. The passageways 54 and 56 introduce compressed gas to an "on-off" flow valve chamber 58, described in greater detail herein. Thereafter a fluid passageway 60 provides compressed gas to a firing chamber 62. In addition, an over-flow passageway 57 is formed in the terminal housing portion 50.

Figure 4:
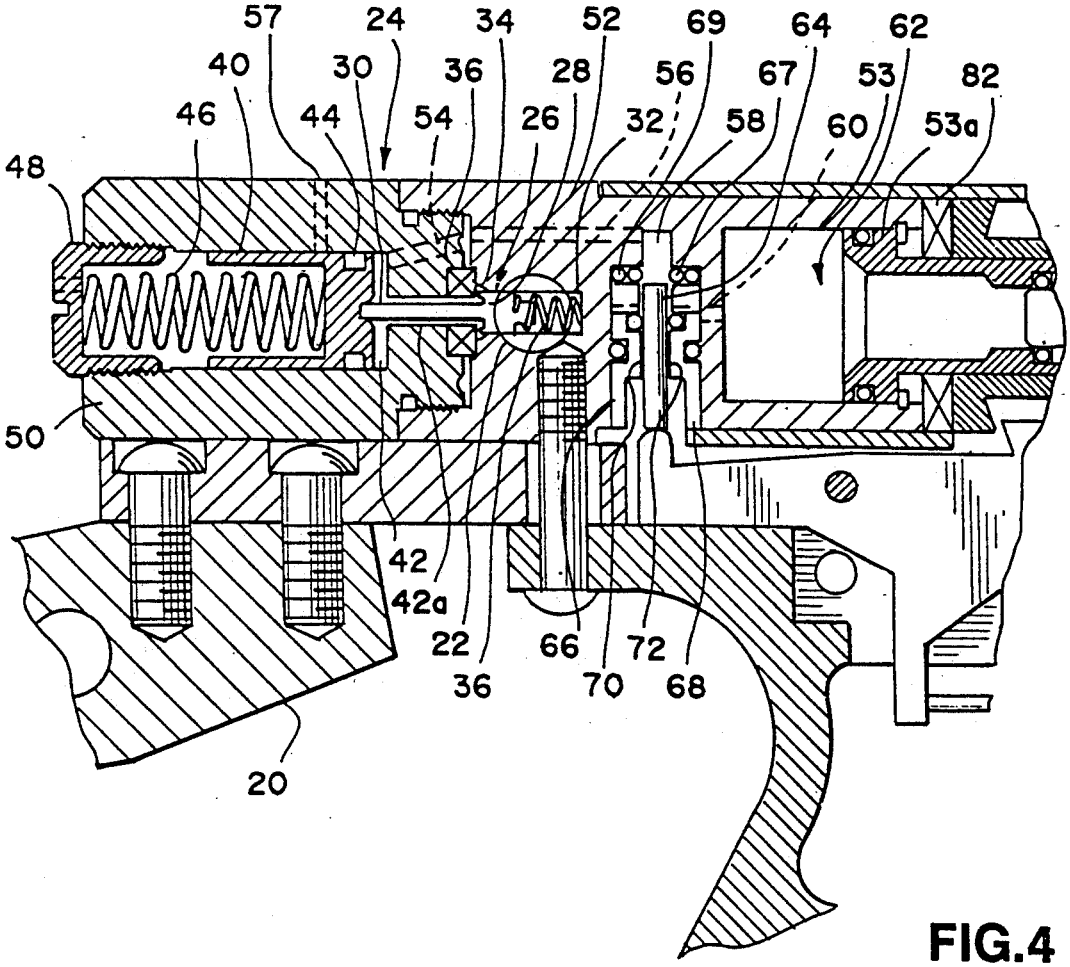
FIG. 4 is an enlarged cross-sectional view of the pressure regulator assembly of the compressed gas gun of FIG. 2 shown in greater detail.

As best seen in FIG. 4, the pressure regulating assembly 24 operates to control the compressed gas pressure received from the $CO_2$ cartridge 18 and thereafter supplied to the air firing chamber 62. The pressure regulating assembly 24 includes a regulating piston 40 received within the longitudinal bore 42 formed in the terminal housing portion 50. The regulating assembly further includes a valve 26 having a head portion 28 and a stem 30. The head portion 28 is disposed in the valve chamber 32 and is adapted to permit gas flow between the outer periphery of the head portion 28 and the valve chamber 32. The stem 30 extends into the longitudinal bore end section 42*a*. Further, the stem 30 is in contacting relation with the regulating piston 40. An annular seat 36, preferably fabricated of polyurethane, seals the valve chamber when the head portion 28 contacts the seat 36. The annular seat 36 prevents movement of the valve in a rearward direction beyond the closed position. Compressed gas provided by the inlet passageway 22 and a biasing spring 36 coact to maintain closure tension on the valve 26.

As noted above, the valve chamber 32 communicates with the passageway 22 and is adapted to receive compressed gas from the inlet passageway 22. In this arrangement, compressed gas supplied from the $CO_2$ cartridge 18 within the longitudinal bore 42 tends to urge the regulating piston 40 rearward and increases the level of pressure supplied to the firing chamber 62 so long as the valve 26 remains open. The pressure regulating assembly 24 further includes means for counteracting the force exerted on the piston 40 by the gas supplied to the firing chamber 62. A regulating spring 46 biases the regulating piston 40 toward a forward position within the longitudinal bore, which in turn, acts to move the valve head section 28 away from the valve seat 36. The regulating piston 40 remains in the forward position to prevent the valve 26 from closing until a predetermined level of pressure is supplied to the longitudinal bore 42 and to the firing chamber 62. When the predetermined level is supplied to the bore 42 and to the firing chamber 62, the regulating piston 40 is moved to a rearward position to permit the valve 26 to close and to seal the valve chamber 32.

Adjustment for the regulating spring 46 is controlled by a threaded adjusting cap 48. Manual adjustment of the threaded cap 48 controls the amount of force exerted by the regulating spring 46. For example, when an increased tension is applied to the regulating piston 40, a higher pressure is required to urge the regulating piston 40 rearward to permit the valve 26 to close. Accordingly, the firing chamber 62 is charged with an increased gas pressure. The over-flow passageway operates to relieve pressure from the pressure delivery system in the case of seal failure or disassembly of the system under pressure.

However, when the air pressure in the firing chamber 62 falls below the predetermined level such as after a firing sequence, the regulating piston 40 moves to the forward position to open the valve 26. Compressed gas supplied to the firing chamber 62 thereafter acts against the regulating spring tension to move the piston 40 rearward. In this manner, compressed gas is again discharged until the pressure in the firing chamber 62 reaches the predetermined level sufficient to urge the regulating piston 40 rearward to permit the valve 26 to close. In the preferred embodiment, the regulating assembly 24 operates to reduce the pressure passed to the firing chamber 62 to approximately 450 psi. This insures precise operation of the gun 10 irrespective of very cold ambient temperature.

Figure 3:
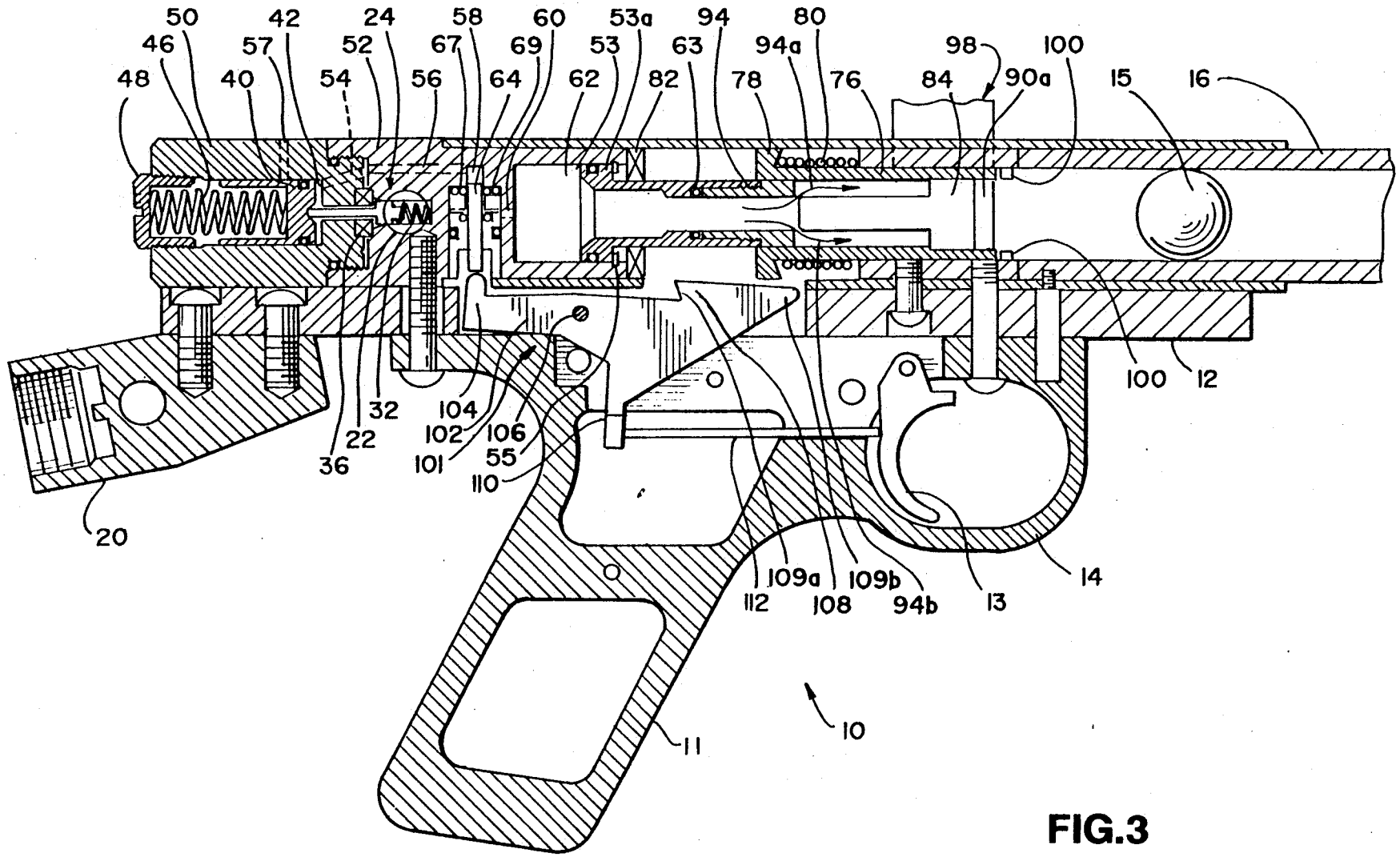
FIG. 3 is a sectional view of the compressed gas gun in FIG. 2 with the actuating bolt assembly in a released position, as during a firing operation.

Accordingly, the pressure regulating assembly 24 maintains that a reservoir of gas at the predetermined pressure is supplied to the firing chamber 62 for successive firings. If the ambient temperature increases, thereby increasing the gas pressure in the longitudinal bore 42, the spring 46 is urged rearward to close the valve 26. As shown in FIGS. 2, 3 and 4, if the ambient temperature increases to a point where the pressure in the longitudinal bore 42 exceeds the predetermined pressure and compressed gas supply pressure, the head 28 will move forwardly allowing gas in the longitudinal bore 42 to reenter the compressed gas supply. Conversely, when the ambient temperature decreases, thereby decreasing the pressure in longitudinal bore 42, the gas reservoir pressure decreases, and spring 46 extends forward to open the valve 26. In this way, the pressure regulating assembly corrects for incremental pressure variations due to ambient temperature changes, slight leakages and the like and insures that the compressed gas provided in the longitudinal bore 42 is maintained at a predetermined pressure for each firing. Maintaining the gas pressure at the predetermined pressure provides consistent operation of the gun.

As best seen in FIGS. 2 and 4, the "on-off" flow valve 64 is restrained from longitudinal movement by a pair of bushings 66 and 68. The bushings 66 and 68 include bearing surfaces 70 and 72 to facilitate transverse movement of the on-off valve member 64 within the flow valve chamber 58. In addition, pairs of ring seal members 67 and 69 prevent the escape of compressed air in the on-off valve member 64. It will be appreciated that when an "on-off" valve 64 is moved to the "on" position (FIG. 2 or 4), a regulated supply of pressurized air is received within the air chamber 62. When the on-off valve is moved to the closed position, as best seen in FIG. 3, the air firing chamber 62 is effectively sealed from and isolated from the pressure regulating assembly 24. This feature prevents operation of the pressure regulating assembly 24 to pass compressed gas until the on-off valve is opened.

FIG. 2 also shows the firing chamber 62 according to the invention. The firing chamber is defined by a bore 53 formed in the body portion 52 of the gun 10 and by an intermediate firing or power tube **53*a*. The intermediate power tube 53*a* is adapted for placement within the bore 53 and is prevented from longitudinal movement within in the bore with a ring 55 adapted to fit within a notch formed in the body portion 52. An annular power sleeve 94 interfits within the intermediate tube 53*a* to provide a discharge path for compressed air resident in the air firing chamber 62, as will become more fully apparent. An O-ring seal 63 prevents escape of the compressed air between the intermediate power tube 53*a* and power sleeve 94. Inasmuch as the pressure supplied to the firing chamber 62 has been substantially reduced from the maximum available pressure generated by the $CO_2$ cartridge 18** at room temperature, the volume defined by the firing chamber is substantially larger than found in known arrangements.

Figure 6:
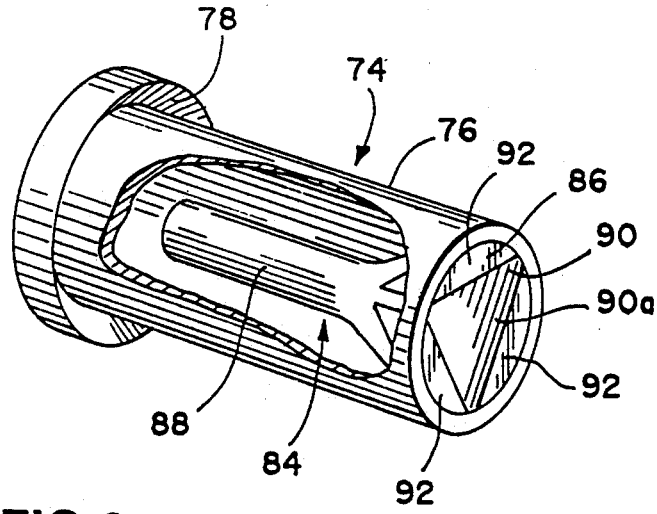
FIG. 6 is a perspective view of the actuating bolt assembly shown in FIGS. 2 and 3 according to the present invention.

FIG. 2 and FIG. 6 show an actuating bolt assembly 74 of the present invention. The actuating bolt assembly 74 comprises a generally cylindrical actuating bolt 76 placed in surrounding relation to a power piston 84. The actuating bolt 76 includes a radially protruding dog portion 78 disposed at one end of the actuating bolt 76. The actuating bolt 76 is slidably mounted circumjacent to a portion of the intermediate power tube **53*a* and the power sleeve 94. A recoil spring 80 retracts the actuating bolt 76 against a bumper 82** in the ready-to-fire position.

As best seen in FIG. 6, the power piston 84 includes a head portion 86 and a tail portion 88 disposed within the actuating bolt 76. Preferably, the head portion 86 is sized and dimensioned for press-fit mounting and soldered within the actuating bolt 76 for rigidly securing the head portion 86 within the bolt 76. The power piston 84 has a triangular face 90 which defines cavities 92 within the head section for permitting compressed gas to flow therethrough during a firing sequence. A resilient bumper **90*a* may be used to absorb shock received by the projectile 15**.

The tail portion 88 is sized for placement within an annular power sleeve 94. In the preferred embodiment, the distal end of the tail portion 88 is slightly chamfered. When the piston is in the closed or ready-to-fire position shown in FIG. 2, the O-ring seal 63 engages the outer surface of the tail section 88 to prevent gas flow in the annual power sleeve 94.

FIG. 2 also shows a ball-feed chute 98 for loading projectiles within a breech 99 of the gun 10. Each succeeding projectile 15 is loaded from the chute 98 and into the breach 99 upon the force of gravity as will be understood by those skilled in the art. Three equispaced rubber nubbins 100, however, prevent the projectile 15 from rolling or otherwise moving longitudinally within the barrel 16 prior to firing, which may otherwise result in a misfeed or double feed of successive projectiles.

FIG. 2 shows the firing mechanism for the gun 10 in a cocked or ready-to-fire position. The illustrated firing mechanism comprises sear 101 having a pivotable latch arm 102, a transversely extending cam portion 104 at one end, located on side of a pivot 106, and a transversely extending interlocking element 108 at the other end, on the other side of the pivot. The cam portion 104 is generally aligned with the "on-off" valve 64, as illustrated in FIG. 2. While the illustrated embodiment shows a protruding cam section 104, the portion of the latch arm opposite the pivot 106 and interlocking element 108 may itself be used with appropriate modification to the size and dimension of the flow valve 64. The interlocking element 108 includes a notched portion 109*a* that engages the dog portion 78 of the actuating bolt 76 in the ready-to-fire position. Further, the interlocking element 108 includes an elongated portion 109*b* extending substantially along the path of travel of the actuating bolt assembly 76. This feature provides a stop surface to prevent the actuating bolt dog portion 78 from engagement with the notched portion 109*a* during a discharge or recoil sequence of the actuating bolt assembly 76.

An actuating lever means 110 projects transversely on the side of the latch arm 102 opposite the cam portion 104 and the bolt interlocking element 108. The sear 101 preferably is a single unitary component as can be seen in FIG. 2, and as such can be appropriately formed of steel. A sliding trigger arm 112 is disposed within the handle 12 and operates to transmit force from the trigger 13 to the actuating finger 110.

FIG. 3 illustrates the sear 101 and the actuating bolt assembly 74 in a released position. When the actuating bolt assembly is released from the interlocking element 108, the compressed gas in the firing chamber 62 rapidly moves the tail portion 88 slightly beyond the distal end of the power sleeve 94 to the position shown in FIG. 3. The forward movement of the actuating bolt assembly 74 urges the projectile 15 slightly forward beyond the nubbins 100 in the breech 99 to prevent any restriction of movement to the projectile 15. In addition, the actuating bolt 76 moves longitudinally sufficiently to seal the feed chute 98 to prevent a possible double feed and to prevent discharge into the feed chute.

When the tail section 88 has exited the power sleeve 94, an air blast exhausts from the firing chamber 62 in the direction of arrows 94*a* and 94*b*. The air blast passes through the cavities 86 defined in the piston head section 90 (FIG. 6) and to the breach 99 to impart motion on the projectile 15. The recoil spring 80 is substantially compressed to move the actuating bolt assembly 76 rearward when the compressed air is exhausted from the firing chamber 62.

FIG. 3 also shows the "on-off" flow valve 64 in the closed position. Preferably, the sear 101 is adapted to rotate the cam section 104 to close the valve 64 prior to release of the actuating bolt assembly 76. This arrangement insures that no change in fluid pressure will be sensed by the pressure regulating assembly 24 which otherwise may begin to recharge the firing chamber before the actuating assembly 76 recoils.

In operation, pressure supplied to the pressure regulating assembly 24 opens the regulating valve piston 40 and permits compressed gas to travel through the passageways 54 and 56, passing through the on-off flow valve 62 and into the air chamber 62. When pressure in the air chamber 62 and passageways 54 and 56 rise to a predetermined level to overcome the tension applied by the regulating spring 46, the regulating piston 40 is moved rearward to close the valve 26 thereby providing the desired pressure within the chamber 62.

Compressed gas collected in the firing chamber 62 applies a continuous pressure to the power piston 84 and to the actuating bolt 76. The power piston 84 and actuating bolt 78 move together but are restrained in a retracted position by the dog portion 78 which is engaged by the interlocking portion 108.

In the first step of a firing sequence, the sear 101 is actuated by the sliding arm 112 which is moved longitudinally by the trigger 13. When the trigger 13 is retracted, the arm 112 rotates the actuating lever element 110 in a clockwise movement which in turn rotates the pivotal latch arm 102. This movement forces the "on-off" valve 64 to close in response to the camming action of the cam portion 104. When the on-off flow valve 64 is closed, the interlocking portion 108 releases the actuating bolt dog portion 78 and the compressed gas in the firing chamber 62 moves the power piston longitudinally rapidly forward to move the projectile 15 past the rubber nubbins 100 in the position shown in FIG. 3. In this forward position, the actuating bolt 76 closes the ball feed chute 98 to prevent an accidental double feed and, perhaps more importantly, to seal the feed chute 98 for directing the air blast toward the projectile 15.

Compressed gas in the firing chamber 62 continues to move the power piston 84 forward and a blast of compressed gas exits the power sleeve in the direction shown by arrows 94*a* and 94*b*. The blast is released through the power piston cavities 92 to permit the blast within the breech 99. The blast engages the projectile 15 in this forward position. Upon receipt of the blast, the marking projectile is propelled from the barrel.

Upon release of the compressed gas resident in the air chamber 62, the recoil spring 80 drives the actuating bolt 76 rearwardly against the bumper 82 where it is held in place by the recoil spring 80. When the trigger 13 is released, the actuating bolt 76 is again restrained by the latch arm interlocking portion 108 and held in position for subsequent firing in the following manner. The gas pressure maintained in the passageways 54, 56 and the on-off valve chamber 58 continues to exert a downward force on the flow valve 64. Upon release of the trigger 13, the force moves the cam section 104 to effect slight counterclockwise motion of the latch arm both to latch the actuating bolt assembly 76 and to open the on-off flow valve 64. This also reduces the pressure applied to the regulating piston 40 which thereafter reopens the valve 26 to recharge the firing chamber 62 for the next firing cycle. The next succeeding projectile feeds downwardly to the position shown in FIG. 2 when unobstructed by the recoiled actuating bolt 76.

Figure 5A:
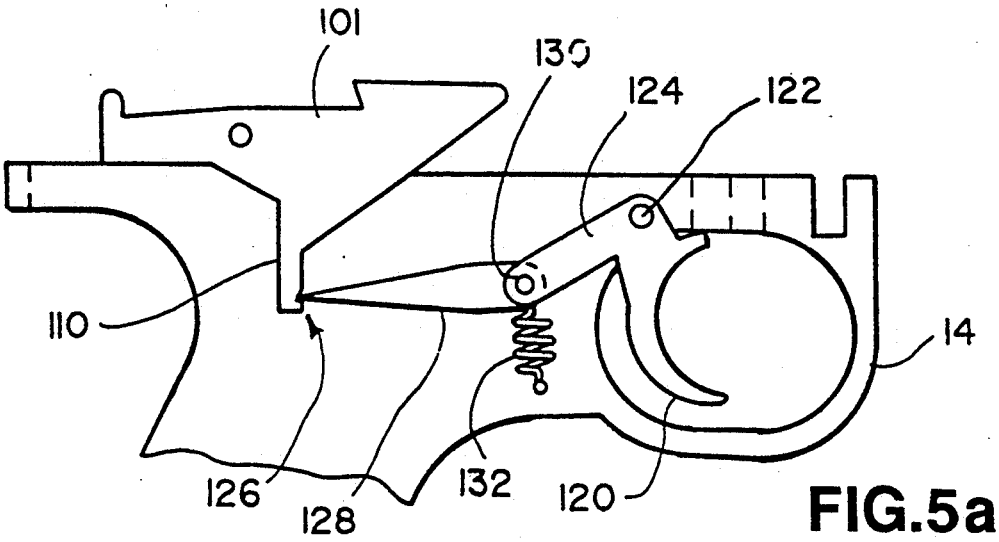
FIGS. 5*a–c* are side views of a trigger assembly in an alternative embodiment showing a firing sequence initiated by both depression and release of the trigger according to the invention.
Figure 5B:
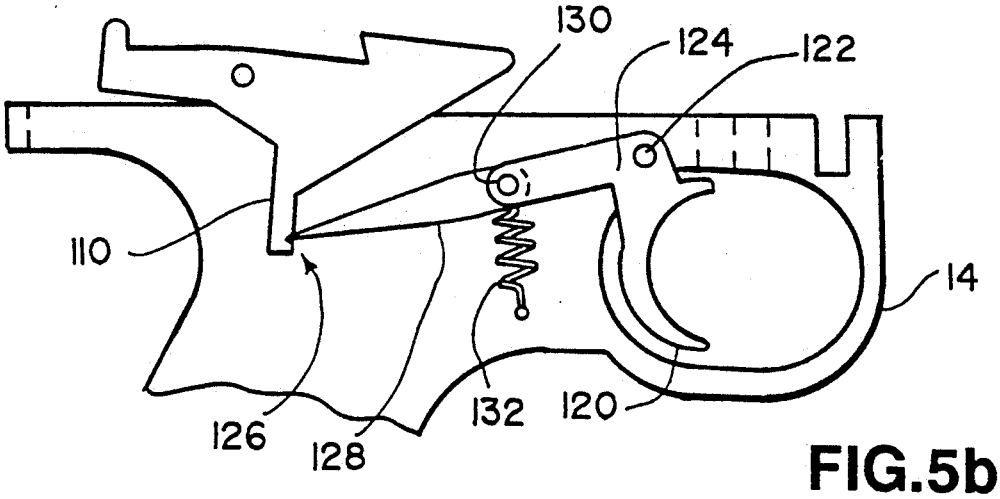
Figure 5C:
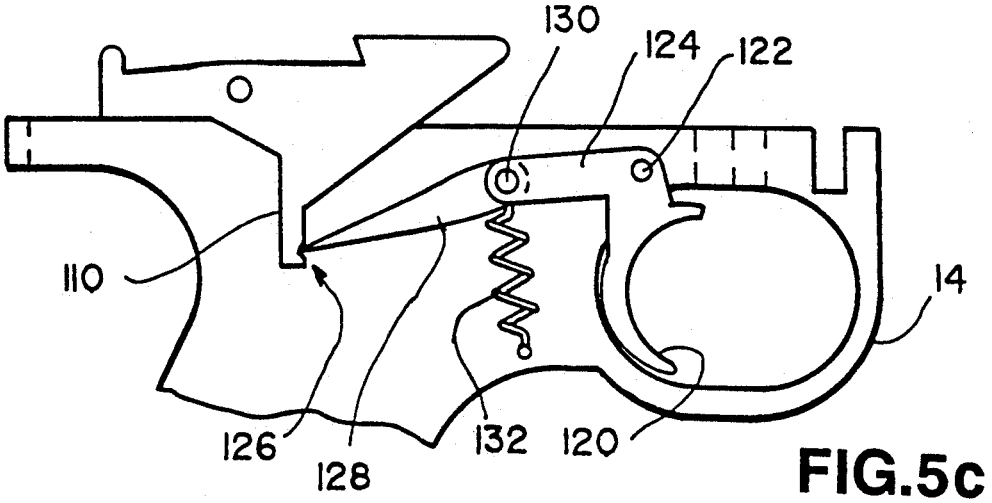

FIGS. 5*a–c* illustrate an alternate embodiment of the present invention for initiating successive firing sequences upon the depression and/or release of the trigger. In particular, FIG. 5*a* shows a trigger 120 rotatably mounted to the trigger guard 14 at a pivot 122. The trigger 120 includes a trigger arm 124 extending from the pivot 122. FIG. 5*a* also shows a sear 101 having a recess 126 in the actuating lever 110. The details and operation of the sear 101 are otherwise the same as described above.

A link arm 128 couples the trigger 120 with the sear 101. The link arm 128 is rotatably mounted at one end to the trigger arm 124 at a pivot 130, and at the other end, is adapted to fit within the actuating lever recess 126. A biasing spring 132 is also operatively connected with trigger arm 130 and the link arm 128 at the pivot 130.

FIG. 5*a* shows the trigger 120 in a cocked or read-to-fire position. In this position, the interlocking element 108 engages the actuating bolt assembly (not shown) of the gun. In FIG. 5*b*, the trigger arm 124 and the link arm 128 have articulated to a fully extended position. In this position, the latch arm 102 has rotated in a clockwise direction in reaction to the force imparted to the lever arm 110. As described above, this action actuates the firing mechanism for propelling the projectile. The trigger 120 in this position has been depressed at a mid-point in the firing stroke.

In FIG. 5*c*, the trigger has been fully depressed. In this position, the latch arm 102 has rotated in a counter-clockwise direction to recock the gun. When the trigger is released, tension supplied by the biasing spring 132 at the pivot 132 articulates the trigger arm 124 and link arm 128 to a fully extended position to rotate the latch arm 102 in a clockwise direction for initiating a successive firing and reload sequence.

From the description thus far provided, a gas gun that overcomes the aforestated problems with the prior art by providing a simple and efficient firing and reload mechanism without the use of blow back or other complex pressure schemes has been described. It will be apparent that the proposed gun may be used in a number of applications and that a number of modifications can be made in the invention disclosed, particularly by those having the benefit of the foregoing teachings, without departing from the spirit of these principles. However, these features preferably are utilized together in the advantageous assembly described herein. Accordingly, while the invention disclosed herein has been described with reference to the presently contemplated best mode for practicing the invention, it is intended that this invention be limited only by the scope of the appended claims.

What is claimed is:

1. A compressed gas powered gun for firing a projectile disposed in an elongated barrel upon the depression of a trigger comprising:

a compressed gas source disposed to supply compressed gas;

a firing chamber coupled with said compressed gas source receiving at least a portion of compressed gas from said source, said firing chamber having at least a portion defined by an elongated receptacle;

a flow valve disposed between said compressed gas source and said firing chamber said flow valve having an open position to permit compressed gas to flow therethrough and a closed position to isolate said firing chamber from said compressed gas source to maintain a predetermined pressure in said firing chamber when said trigger is depressed;

an actuating bolt assembly movable between a fire position and a ready-to-fire position, said actuating bolt assembly having a sleeve with a dog portion, a piston received within at least a portion of said sleeve, and a spring disposed to return said actuating bolt assembly to the ready-to-fire position, said sleeve having at least a portion surrounding said elongated receptacle in both the fire position and the ready-to-fire position to direct compressed gas therethrough in the fire position, said piston having a portion received within said elongated receptacle for sealing said firing chamber when in the ready-to-fire position and exited from said elongated receptacle for permitting discharge of compressed gas from the firing chamber through said elongated receptacle when in the fire position; and a sear having a pivoting latch arm with an interlocking member disposed on one end of said latch arm for engaging said dog portion in the ready-to-fire position, a cam section disposed on the other end of said latch arm engaged with said flow valve, and an actuating lever, disposed opposite both said interlocking member and said cam section and coupled with said trigger, for rotating said latch arm to extend said cam section to close said flow valve to isolate said firing chamber from said compressed gas source and to retract said interlocking member to disengage said interlocking member from said dog portion when said trigger is depressed to return said sear to the ready-to-fire position engaging said dog portion of said actuating bolt assembly without manual movement of said actuating bolt assembly.

2. The compressed gas powered gun of claim 1 further comprising projectile feeding means associated with said barrel for depositing projectiles into said barrel, the configuration and relative positioning of said actuating bolt assembly and said projectile feeding means being such that said actuating bolt assembly precludes receipt of said projectiles from said feeding means in the fire position and permits receipt of said projectiles in the ready-to-fire position.

3. The compressed gas powered gun of claim 2 further comprising projectile feed stop means disposed in said barrel relative to said projectile feeding means, said projectile feed stop means adapted to prevent longitudinal movement of a projectile received in said barrel until said actuating bolt assembly moves to the fire position.

4. A semiautomatic firing system having a fire position for discharging a projectile of the fragile gelatinous type upon the depression of a trigger, and thereafter returning to a ready-to-fire position upon the release of the trigger for use in a compressed gas powered gun including a barrel for loading the projectile, a firing chamber including an exhaust tube for supplying compressed gas to impart a force on the projectile, and a compressed gas supply disposed to supply said firing chamber with compressed gas, said firing system comprising:

an actuating bolt assembly movable between a fire position and ready-to-fire position, said actuating bolt assembly having a sleeve with at least a portion surrounding said exhaust tube in both the fire and ready-to-fire positions, a dog portion attached to said sleeve, and a piston received within said exhaust tube to inhibit discharge of compressed gas from said exhaust tube in the ready-to-fire position and at least partially exited from said exhaust tube in the fire position to permit discharge of compressed gas longitudinally through said exhaust tube;

a recoil spring disposed to return said actuating bolt assembly to the ready-to-fire position upon the discharge of said firing chamber;

a flow valve disposed between said gas supply and said firing chamber permitting gas to flow to said firing chamber in the ready-to-fire position, said flow valve isolating said firing chamber rom said gas supply to maintain a predetermined pressure in said firing chamber in the fire position;

pressure regulating means coupled with said compressed gas source and said firing chamber for receiving compressed gas from said source and for supplying a preselected amount of compressed gas to said firing chamber when said flow valve is in said ready-to-fire position;

a sear having a pivoting latch arm with an interlocking member disposed on one end of said latch arm and adapted to engage said dog portion in the ready-to-fire position, a cam section disposed on the other end of said latch arm engaged with said flow valve, and an actuating lever disposed opposite both said interlocking member and said cam section and coupled with said trigger;

said actuating lever rotating said latch arm to extend said cam section to close said flow valve and to retract said interlocking member to disengage said interlocking member from said dog portion, thereby releasing said actuating bolt assembly from the ready-to-fire position to the fire position when said trigger is depressed; and said flow valve being operable to automatically return said firing system to the ready-to-fire position by moving said cam section to counterrotate said latch arm for engaging said interlocking member with said dog portion, thereby restraining said actuating bolt assembly in the ready-to-fire position when said firing chamber has discharged and when said trigger is released.

5. A semiautomatic compressed gas powered gun for discharging a projectile disposed in an elongated barrel upon the depression of a trigger and thereafter self-loading for discharging a next succeeding projectile comprising:

a compressed gas source;

a firing chamber in fluid communication with said compressed gas source for receiving at least a portion of compressed gas supplied from said source and for supplying compressed gas to expel the projectile through said barrel;

a flow valve disposed between said compressed gas source and said firing chamber having an open position for permitting compressed gas to flow therethrough and a closed position for isolating said firing chamber from said source to maintain a predetermined pressure in said firing chamber when said trigger is depressed;

an actuating bolt member operable to seal said firing chamber in a ready-to-fire position and to direct compressed gas discharged from said firing chamber toward the projectile in a fire position, said bolt member including a dog portion, and means for returning said actuating bolt member to the ready-to-fire position after compressed gas in said firing chamber is discharged;

a sear having a pivoting latch arm with an interlocking member disposed on one end of said latch arm adapted to engage said dog portion in the ready-to-fire position to restrain said actuating bolt member, a cam section disposed on the other end of said latch arm engaged with said flow valve, and an actuating lever disposed opposite both said interlocking member and said cam section and coupled with said trigger;

said actuating lever rotating said latch arm to extend said cam section to close said flow valve and to retract said interlocking member to disengage said interlocking member from said dog portion thereby releasing said actuating bolt member when said trigger is depressed; and said flow valve operable to automatically return said sear to the ready to fire position by moving said cam section to counterrotate said latch arm for engaging said interlocking member with said dog portion thereby restraining said actuating bolt member in the ready-to-fire position when said firing chamber has disengaged and when said trigger is released.

6. The compressed gas gun of claim 5 wherein said firing chamber includes discharge tube means, said actuating bolt member further comprising:

a sleeve with at least a portion surrounding said discharge tube means in both the ready-to-fire position and the fire position, said dog portion attached to said sleeve; and a piston integrally associated with said sleeve, said piston received within said discharge tube means in the ready-to-fire position to prevent discharge of compressed gas in said firing chamber and exited from said discharge tube means in the fire position to permit discharge of compressed gas longitudinally within said sleeve.

7. The compressed gas gun of claim 6 further comprising projectile feeding means associated with said barrel for depositing projectiles into said barrel, the configuration and relative positioning of said actuating bolt sleeve and said projectile feeding means being such that said actuating bolt sleeve precludes receipt of said projectiles within said barrel in the fire position and permits receipt of said projectiles in the ready-to-fire position.

8. The compressed gas gun of claim 7 further comprising projectile feed stop means disposed in said barrel relative to said projectile feeding means, said projectile feed stop means adapted to prevent movement of a projectile received in said barrel until said actuating bolt member moves to the fire position.

9. A firing mechanism for discharging a projectile in a fire position and thereafter returning to a ready-to-fire position in a compressed gas powered gun including a barrel for loading the projectile, a firing chamber for supplying compressed gas to expel the projectile through the barrel, a compressed gas supply disposed to supply compressed gas to said firing chamber, and a flow valve disposed between said supply and said firing chamber for selectively isolating said firing chamber from said supply, said firing mechanism comprising:

a trigger assembly including an elongated member and a link piece, said link piece pivotally mounted to said elongated member and cooperating with said elongated member to move said firing mechanism to the ready-to-fire position when said trigger is both fully depressed and fully released to move said firing mechanism to the fire position at a selected point therebetween;

an actuating bolt member operable to seal said firing chamber in the ready-to-fire position and to direct compressed gas from said firing chamber toward the projectile in the fire position, said bolt assembly including a dog portion, and means for returning said actuating bolt assembly to the ready-to-fire position upon the discharge of said firing chamber;

a sear having a pivoting latch arm with an interlocking member disposed on one end of said latch arm adapted to engage said dog portion in the ready-to-fire position, a cam section disposed on the other end of said latch arm operatively associated with said flow valve, and an actuating lever disposed opposite both said interlocking member and said cam section and coupled with said link piece;

said actuating lever rotating said latch arm to extend said cam section to close said flow valve and to retract said interlocking member to disengage said interlocking member from said dog portion thereby releasing said actuating bolt assembly when said trigger is moved to said selected point; and said flow valve operable to move said cam section to counterrotate said latch arm for engaging said interlocking member with said dog portion thereby restraining said actuating bolt assembly in the ready to fire position when said firing chamber has discharged and when said trigger is either fully depressed or fully released.

10. A semi-automatic compressed gas powered gun for discharging a projectile disposed in an elongated barrel upon the depression of a trigger and thereafter self-loading for discharging a next succeeding projectile comprising:

a compressed gas source;

a firing chamber in fluid communication with said compressed gas source for receiving at least a portion of compressed gas supplied from said source and for supplying compressed gas to expel the projectile through said barrel;

a flow valve disposed between said compressed gas source and said firing chamber having an open position for permitting compressed gas to flow therethrough and a closed position for sealing said firing chamber from said source;

an actuating bolt member operable to seal said firing chamber in a ready-to-fire position and to direct compressed gas discharged from said firing chamber toward the projectile in a fire position, said bolt member including a dog portion, and means for returning said actuating bolt member to the ready-to-fire position after compressed gas in said firing chamber is discharged;

a sear having a pivoting latch arm with an interlocking member disposed on one end of said latch arm adapted to engage said dog portion in the ready-to-fire position to restrain said actuating bolt member, a cam section disposed on the other end of said latch arm engaged with said flow valve, and an actuating lever disposed opposite both said interlocking member and said cam section and coupled with said trigger;

said actuating lever rotating said latch arm to extend said cam section to close said flow valve and to retract said interlocking member to disengage said interlocking member from said dog portion thereby releasing said actuating bolt member when said trigger is depressed;

said flow valve operable to move said cam section to counterrotate said latch arm for engaging said interlocking member with said dog portion thereby restraining said actuating bolt member in the ready-to-fire position when said firing chamber has discharged and when said trigger is released; and a pressure regulating assembly for controlling the pressure of compressed gas supplied from said source to said firing chamber, said pressure regulating assembly including a longitudinal valve chamber for receiving said compressed gas from said source, a valve disposed in said chamber and operable to move between an open position for passing compressed gas received from said source and a closed position for restricting compressed gas received from said source, and valve regulating means in communication with said valve chamber and said flow valve including sensing means for permitting said valve to move to said closed position when a predetermined pressure of compressed gas is sensed and for urging said valve to said open position when a pressure less than said predetermined pressure is sensed.

11. The compressed gas gun of claim 10, wherein said valve regulating means includes a longitudinal bore disposed downstream of said valve means and said source for passing compressed gas to said flow valve means, said sensing means comprising:

piston means disposed in said bore and coupled with said valve means, said piston means being displaced in response to the pressure of compressed gas received in said bore; and spring biasing means coupled with said piston means and having a preselected tension to restrict movement of said piston means to prevent said valve means from moving to the closed position until said predetermined pressure is received in said longitudinal bore.

12. A system for supplying a predetermined pressure of compressed gas in a compressed gas powered gun, the gun including a barrel for loading a projectile, and a firing mechanism operable in a first mode to actuate said gun and operable in a second mode to return said gun to a ready-to-fire position, said system comprising:

a source supplying compressed gas at a first outlet;

a firing chamber for supplying compressed gas to expel the projectile through the barrel;

a pressure regulating assembly coupled with said first outlet and said firing chamber for receiving compressed gas from said first outlet and for providing said predetermined pressure of compressed gas to said firing chamber at a second outlet; and a flow valve disposed between said second outlet and said firing chamber and coupled with said firing mechanism, said flow valve isolating said second outlet from said firing chamber when said firing mechanism is in said first mode for maintaining said predetermined pressure in said firing chamber, said flow valve urging said firing mechanism to said second mode upon discharge of said firing chamber and providing fluid communication between said second outlet and said firing chamber when said firing mechanism is in said second mode.

13. The system of claim 12, wherein said pressure regulating assembly supplies said predetermined pressure of compressed gas to said firing chamber for successive firings.

* * * * *